United States Patent [19]

Hester

[11] 4,009,591

[45] Mar. 1, 1977

[54] SINGLE EVAPORATOR, SINGLE FAN COMBINATION REFRIGERATOR WITH INDEPENDENT TEMPERATURE CONTROLS

[75] Inventor: William F. Hester, Louisville, Ky.

[73] Assignee: General Electric Company, Louisville, Ky.

[22] Filed: Jan. 2, 1976

[21] Appl. No.: 646,196

[52] U.S. Cl. ..... 62/180; 62/187; 62/455

[51] Int. Cl.[2] ..... F25D 17/00

[58] Field of Search ..... 62/180, 187, 455

[56] References Cited

UNITED STATES PATENTS

| | | | |
|---|---|---|---|
| 2,863,300 | 12/1958 | Murphy et al. | 62/180 |
| 3,005,321 | 10/1961 | Devery | 62/186 |
| 3,126,717 | 3/1964 | Schumacher | 62/180 |
| 3,320,761 | 5/1967 | Gelbard | 62/180 |
| 3,793,847 | 2/1974 | Scarlett et al. | 62/190 |

*Primary Examiner*—William E. Wayner
*Assistant Examiner*—R. J. Charvat
*Attorney, Agent, or Firm*—Steven C. Schnedler; Francis H. Boos

[57] ABSTRACT

A single evaporator, single fan combination refrigerator includes a temperature control system which thermostatically maintains the fresh food compartment at a desired temperature by cycling the refrigerator system on and off as required, and which controls freezer compartment temperature by varying airflow through a duct conducting refrigerated air from the evaporator chamber to the fresh food compartment. Variable airflow control apparatus comprising a mechanical summer operating an air valve varies airflow through the duct as a function of the settings of both the fresh food control and the freezer control.

6 Claims, 7 Drawing Figures

SINGLE EVAPORATOR, SINGLE FAN COMBINATION REFRIGERATOR WITH INDEPENDENT TEMPERATURE CONTROLS

CROSS REFERENCE TO RELATED APPLICATION

The present invention is partly disclosed, but not claimed, in copending application Ser. No. 646,167, filed Jan. 2, 1976, concurrently herewith, by William M. Webb and William F. Hester, also entitled SINGLE EVAPORATOR, SINGLE FAN COMBINATION REFRIGERATOR WITH INDEPENDENT TEMPERATURE CONTOLS, and assigned to the same assignee as the present invention.

BACKGROUND OF THE INVENTION

1. Field of the Invention

The present invention relates to household refrigerators and more particularly to a temperature control system for a single evaporator, single fan type combination refrigerator including independent freezer compartment and fresh food compartment temperature controls.

2. Description of the Prior Art

Combination refrigerators of the "frost free" type including a single evaporator and a single fan for circulating air from the freezer and the fresh food compartments over the evaporator are well known. Examples are disclosed in U.S. Pat. No. 3,126,177—Schumacher and in U.S. Pat. No. 3,320,761—Gelbard. In such refrigerators, a major portion (approximately 90%) of the refrigerated air from the evaporator is directed through a passageway into the freezer compartment while a smaller portion (approximately 10%) is directed through a duct into the fresh food compartment. Two user-operable temperature control members are provided. One control member is for setting a temperature to be maintained in the fresh food compartment and is typically called either the "fresh food control" or "cold control." The fresh food control dial has graduations from "1" through "9," "1" indicating the warmest temperature and 9 indicating the coldest temperature to be set. The other control member is primarily for determining a preset temperature to be maintained in the freezer compartment and is typically called the "freezer control." The freezer control has graduations from A through E, with E being the coldest position.

The fresh food control is operatively connected to a thermostatic control which senses either fresh food compartment air temperature or a mixture of compartment air and incoming refrigerated air from the evaporator and thermostatically maintains the fresh food compartment temperature near the desired temperature by periodically energizing and de-energizing the refrigeration compressor, and thus the evaporator, in a conventional manner. Usually, the fan is energized and de-energized along with the evaporator. The thermostatic control causes energization of the evaporator when the fresh food compartment temperature exceeds the temperature setting of the fresh food control and causes de-energization of the evaporator when the fresh food compartment temperature is less than the temperature setting of the fresh food control.

The freezer control is connected in simple fashion to an air flow damper positioned in the duct which carries refrigerated air from the evaporator chamber to the fresh food compartment. In operation, as the freezer control is moved toward E, or the coldest position, the damper is closed more, reducing the amount of refrigerated air flowing into the fresh food compartment. Since the temperature in the fresh food compartment is thermostatically controlled, the compressor, under control of the thermostatic control simply runs longer or more often to satisfy the requirements of the fresh food compartment. When the compressor and evaporator run more, more refrigerated air flows into the freezer compartment for a longer period of time and the freezer compartment gets colder. Conversely, as the freezer control is moved toward A, or the warmest position, the damper is opened more, allowing more refrigerated air from the evaporator chamber to flow through the duct into the fresh food compartment. This causes the compressor and the evaporator to be energized less frequently or for shorter periods of time to satisfy the cooling requirements of the fresh food compartment. Since the temperature in the freezer compartment is directly related to the percentage of compressor and evaporator "on" time, the temperature in the freezer compartment decreases.

To summarize the above, in prior art refrigerators the temperature in the fresh food compartment is thermostatically controlled by energizing the compressor and evaporator in response to the cooling requirements of the fresh food compartment. Being under actual thermostatic control, the temperature is maintained quite efficiently at approximately the desired temperature. The temperature in the freezer compartment is not thermostatically controlled, but rather is controlled by varying the flow of refrigerated air from the evaporator chamber to the fresh food compartment, thereby forcing the compressor and evaporator to run for either longer or shorter periods of time to satisfy the requirements of the fresh food compartment, indirectly affecting the temperature in the freezer compartment.

Temperature control systems of the above-described type, while inexpensive and relatively effective, have the disadvantage that the fresh food and freezer controls do not exert truly independent control over the temperatures of the two compartments. The interaction between the temperature controls contributes significantly to customer dissatisfaction and costly complaints. In actual operation, the fresh food control, in addition to desirably setting a temperature to be thermostatically maintained in the fresh food compartment, undesirably affects the temperature of the freezer compartment. This undesirable effect is a direct result of the fact that, as the setting of the fresh food control is varied, in order to satisfy the cooling requirements of the fresh food compartment as determined by the fresh food control setting, the percentage of compressor and evaporator run time also varies. For example, if the compressor runs longer to maintain the fresh food compartment at a lower desired temperature, the freezer temperature also is lowered. The freezer control actually operates as a temperature differential control to maintain the freezer compartment temperature at a given temperature below the fresh food compartment temperature, the given temperature being determined by the setting of the freezer control. If the fresh food control setting is not disturbed, then the freezer control actually does control the temperature in the freezer. However, if the fresh food control setting is changed, with no change in the freezer control setting, the temperature differential between the two compartments is approximately maintained and the temperature in the freezer compartment undesirably goes up or down, depending upon the desired temperature change in the fresh food compartment.

Control interaction in the opposite direction, that is, fresh food compartment temperature variations as a result of changes in the setting of the freezer control, are not a significant problem because fresh food compartment temperature is substantially thermostatically maintained.

A further disadvantage which follows from the basic disadvantage of control interaction is that it is impossible to calibrate the freezer control directly in temperature. Any calibration of the freezer control directly in temperature would be valid only for a particular setting of the fresh food control.

Despite these disadvantages, the above-described prior art system enjoys wide use due to its relative simplicity and low cost. This points up the strict requirement that any improved system, to be practical, must also be relatively simple and low in cost.

A simple approach to the problem would be explaining to the user of the refrigerator the need to readjust the freezer control every time the setting of the fresh food control is changed. An astute user could adjust the controls to maintain the temperatures he desired in both compartments. The labeling of the "fresh food control" as a "cold control" in some refrigerator models is a step in this direction. However, there are problems in such an approach. A refrigerator with controls which appear complex to operate might be more difficult to sell. In the same vein, a detailed explanation might only serve to point out to a potential customer just how much undesirable control interaction there is. Further, many users either would not fully understand an explanation or would simply choose to ignore it.

It is known to mechanically overcome the above-described interactive control problem by thermostatically adjusting the damper in the duct carrying refrigerated air from the evaporator chamber to the fresh food compartment. In such a system, employing what is termed a "thermal damper," the freezer control does not control the damper directly, but rather is connected to a thermostatic control which senses the temperature in the freezer compartment. The control adjusts the damper opening in response to both the freezer compartment temperature and the control setting to thermostatically maintain the freezer compartment temperature. Although such a system works well, it suffers the disadvantage of added complexity with attendant higher cost and greater possibility of failure in use.

Another known way to achieve truly independent temperature control for the fresh food and freezer compartment is to provide separate thermostatically controlled fans for directing refrigerated air from the evaporator chamber to each of the compartments. Each of the fans is controlled in response to a thermostatic control located in the corresponding compartment. Such a system is disclosed in U.S. Pat. No. 3,005,321—Devery. While this system also should effectively provide independent control of the temperatures in the two compartments, it too suffers the disadvantage of complexity. Further, it would require extensive changes to existing refrigerator designs to implement it.

The above-mentioned copending Webb and Hester application Ser. No. 646,167 discloses and claims a generic refrigerator temperature control system which overcomes the problem of control interaction to provide truly independent control over freezer and fresh food compartment temperature. That system conventionally includes apparatus which varies airflow through the duct as a direct function of the setting of the freezer control. Additionally, in order to compensate for undesired changes in freezer temperature which would otherwise result when the setting of the fresh food control is changed, the variable airflow apparatus has an input ganged to the fresh food control and varies airflow as an inverse function of the setting of the fresh food control.

The present invention provides specific embodiments of variable airflow apparatus which controls duct airflow as the desired function of the settings of the two control members.

SUMMARY OF THE INVENTION

A refrigerator, according to the present invention, in one embodiment thereof is an improvement of a refrigerator of the type generally comprising: a freezer compartment; a fresh food compartment; an evaporator in an evaporator chamber; and an air circulation system including a fan, passageways for circulating air from both of the compartments through the evaporator chamber, a passageway for conducting a first stream of air from the evaporator chamber to the freezer compartment, and a duct for conducting a second stream of air from the evaporator chamber to the fresh food compartment. The refrigerator also includes a first user-operable control member for setting a desired temperature to be maintained in the freezer compartment, designated the "freezer control," and a second user-operable control member for setting a second desired temperature to be maintained in the fresh food compartment. As is conventional, the second user-operable control member is designated the "fresh food control" and is operatively connected to a thermostatic control which includes an element for sensing fresh food compartment temperature and which controls the energization of the evaporator to approximately maintain the second preset temperature in the fresh food compartment.

In accordance with the invention, the refrigerator further includes variable air flow control apparatus for varying the flow of refrigerated evaporator chamber air through the duct into the fresh food compartment. The variable air flow apparatus comprises an adjustable air valve and a mechanical summer having an output operatively connected to the air valve. A main input of the mechanical summer is connected to the freezer control and a compensating input is connected to the fresh food control, for ganged operation with the thermostatic control. The arrangement is such that when the freezer control setting is changed to call for a lower temperature to be maintained in the freezer compartment, duct airflow is decreased, and when the freezer control setting is changed to call for a higher temperature to be maintained in the freezer compartment, duct airflow is increased. In order to compensate for undesirable variations in freezer compartment temperature, when the setting of the fresh food control is changed to call for a lower temperature to be maintained in the fresh food compartment, duct airflow is increased, and when the fresh food control setting is changed to call for a higher temperature to be maintained in the fresh food compartment, duct airflow is decreased.

In operation, as the thermostatic fresh food compartment temperature control is manually changed to call, for example, for a higher temperature, the compressor and evaporator, as outlined in the "Background of the Invention," operate less frequently and the fresh food temperature desirably decreases. If no compensation were provided, then the temperature of the freezer compartment would also increase, undesirably. The compensation which the present invention provides through the mechanical summer including a compensating input connected to the fresh food control and an output connected to the adjustable air valve, overcomes the undesirable effect.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
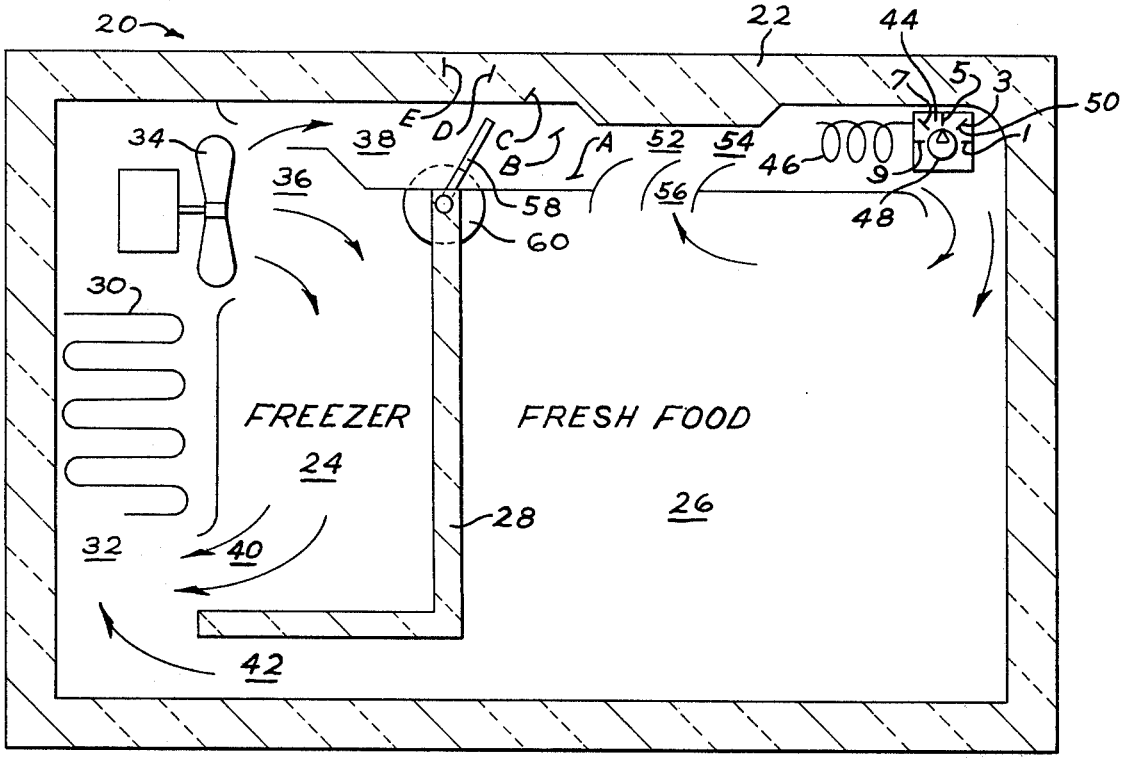
FIG. 1 PRIOR ART
FIG. 1 is a schematic representation of a refrigerator having a prior art temperature control system.

Referring first to FIG. 1, there is illustrated, in schematic form, essential elements of a prior art single evaporator, single fan combination refrigerator 20 as typified by the refrigerators disclosed in the above-mentioned U.S. Pat. Nos. 3,126,717—Schumacher and 3,320,761—Gelbard. It is believed that the present invention and the operation thereof will be better understood with reference to the prior art refrigerator 20 which the invention improves. A description of the prior art refrigerator 20 therefore follows.

The refrigerator 20 generally comprises an insulated outer wall 22 defining a freezer compartment 24 and a fresh food compartment 26. The two compartments are separated by an insulated partition 28. An evaporator 30 for refrigerating the compartments 24 and 26 is contained within an evaporator chamber 32. It will be understood that the refrigerator 20 includes a conventional closed refrigerant circuit (not shown) for energizing the evaporator 30, the refrigerant circuit comprising the usual compressor, condenser, and flow restricting capillary tube. It will further be understood that a conventional radiant heater (not shown) which is periodically energized to defrost the evaporator 30 is also provided.

The refrigerator 20 also includes an air circulating system comprising a fan 34, a passageway 36 for conducting a first stream of air from the evaporator chamber 32 to the freezer compartment 24, a duct 38 for conducting a second stream of air from the evaporator chamber 32 to the fresh food compartment 26, and passageways 40 and 42 for conducting air from the two compartments back to the evaporator chamber 32. Typically, the volume of the first stream of air circulating through the freezer compartment 24 comprises approximately 90% of the total airflow through the evaporator chamber 32, with the airflow through the fresh food compartment 26 making up the remaining 10%.

In order to thermostatically maintain the desired temperature in the fresh food compartment 26, a thermostatic temperature control 44 controls the operation of the compressor (not shown), and thus energization of the evaporator 30, as needed. The thermostatic control 44 comprises a temperature sensing element such as a temperature sensing capillary 46 and an electrical switch (not shown). A first user-operable control member 48, designated the "fresh food control," is operatively connected to the thermostatic control 44. In order to reduce customer complaints which might arise if actual temperatures were indicated on the scale 50 associated with the control member 48, the scale 50 includes arbitrary graduations 1 through 9, 1 being the warmest and 9 being the coldest position.

Preferably, the refrigerated air conducted from the evaporator chamber 32 through the duct 38 into the fresh food compartment 26 is discharged through a nozzle 52 into a mixing chamber 54 so designed that a proportioned amount of fresh food compartment air is drawn through an opening 56 into the mixing chamber 54 by the aspirating effects induced by the air from the nozzle 52 and becomes mixed therewith before the temperature is sensed by the capillary 46 and before the air passes into the fresh food compartment 26. It will be apparent therefore that, rather than merely sensing the temperature of fresh food compartment air, when the fan 34 is running, the temperature sensing capillary 46 associated with thermostatic control 44 actually senses the temperature of a mixture of recirculated fresh food compartment air and refrigerated air supplied to the fresh food compartment 26 from the evaporator chamber 32. Such a system reduces the actual fresh food compartment air temperature drop needed to turn the thermostatic control 44 from "on" to "off," thereby maintaining the fresh food temperature within closer limits than would otherwise be possible. Since the temperature sensed by the capillary 46 is related to the temperature in the fresh food compartment 26, for the purposes herein, the phrase "for sensing temperature in the fresh food compartment" is intended to include such a system. Further details of the nozzle 52, the mixing chamber 54, and the operation thereof are disclosed in the above-mentioned U.S. Pat. No. 3,320,761—Gelbard.

In order to provide control over the air temperature in the freezer compartment 24, an airflow damper 58 is positioned in the duct 38 and operatively connected to a user-operable control member 60. The control member 60 is designated the "freezer control" and has graduations A through E. To obtain a colder temperature in the freezer compartment 14, the freezer control 60 is manually moved towards the E position, causing the damper 58 to further restrict airflow through the duct 38. Due to the resulting decreased refrigerated air supply to the fresh food compartment 26, the evaporator 30 is energized for a greater percentage of time to satisfy cooling requirements of the fresh food compartment 26 to maintain the temperature thereof. Energization of the evaporator 30 occurs, of course, whenever the thermostatic control 44 causes the compressor to operate. Since the temperature within the freezer compartment 24 primarily depends upon the percentage of time the evaporator 30 is energized, the freezer temperature is lowered, as desired.

Conversely, moving the freezer control 60 towards the A position opens the damper 58 more, resulting in more refrigerated air from the evaporator chamber 32 flowing through the duct 38 into the fresh food compartment 26. This results in the evaporator being energized less often or for shorter periods of time, causing a higher freezer compartment temperature, as desired.

While only a single duct 38 and a single damper 58 are illustrated, in certain refrigerators the duct 38 is divided into two parallel ducts and a damper is included in each duct. The dampers operate together so the effect is the same.

The indications associated with the position of the freezer control 60 and the damper 58 necessarily are not calibrated in temperature because, in the prior art refrigerator 20, the actual temperature in the freezer compartment 24 is also dependent upon the setting of the fresh food control 48, as is explained in greater detail in the "Background of the Invention."

Figure 2:
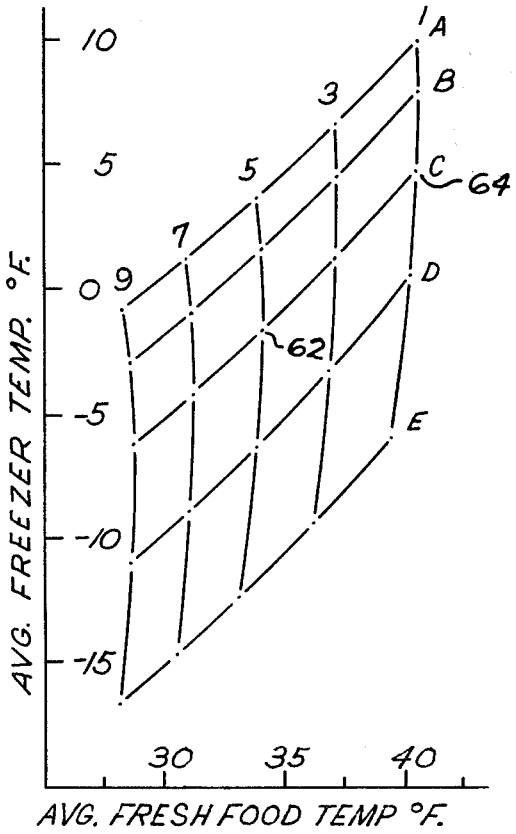
FIG. 2 PRIOR ART
FIG. 2 is a graphical illustration of the temperature control characteristic curve for the control system included in a refrigerator shown in FIG. 1.

Referring now to FIG. 2, exemplary temperature control characteristic curves for the temperature control system in the prior art refrigerator 20 described above with reference to FIG. 1 are graphically illustrated. The characteristic curves show the temperatures to be expected in both the freezer compartment 24 and the fresh food compartment 26 for various combinations of settings of the fresh food control 48 and the freezer control 60. The effects of the two controls are easily distinguished on the graph because the fresh food control 48 has numbered graduations and the freezer control 60 has lettered graduations. For example, if the fresh food control 48 is set at 5 and the freezer control is set at C, it can be determined, from the point designated 62, that the temperature in the freezer compartment 24 is approximately −1° F and the temperature in the fresh food compartment 26 is approximately 34° F. To graphically illustrate the interaction of the fresh food temperature control 48 on the temperature in the freezer compartment 24 in the prior art system, consider an exemplary situation where the freezer control 60 remains set at C and the fresh food compartment temperature control 48 is moved from 5 to 1, calling for a warmer fresh food temperature. The resulting control point is designated 64. As desired, the temperature in the fresh food compartment 26 rises to approximately 38° F. Undesirably, the temperature in the freezer compartment 24 also rises, up from −1° F to 5° F. It will be apparent from the curves shown in FIG. 2 that the interactive effect on the fresh food control 48 on the temperature in the freezer compartment 24 is reflected on the graph by the lines which slope downwardly and to the left beginning at each of the letters A through E. Since the temperature in the fresh food compartment 26 is more nearly maintained at any desired temperature by thermostatic control action, there is very little corresponding interaction of the setting of the freezer control 60 on the temperature in the fresh food compartment 26. This is reflected on the graph by the substantially vertical lines extending downwardly from each of the numbers 1, 3, 5, 7 and 9.

Figure 3:
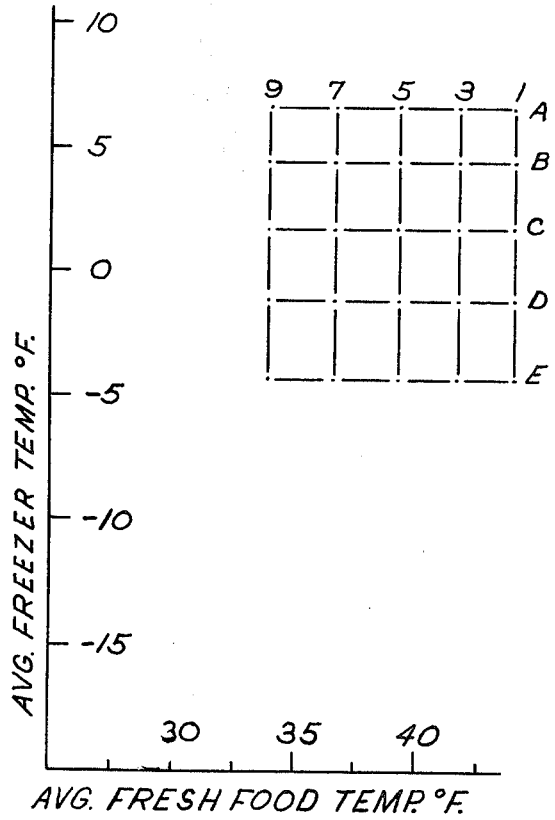
FIG. 3 is a graphical illustration of an optimum temperature control characteristic curve.

Referring to FIG. 3, an optimum temperature control characteristic curve is illustrated. As can be seen in FIG. 3, desirably the settings of the fresh food control 48 (represented by numbers 1, 3, 5, 7 and 9) affect only the temperature in the fresh food compartment 26 and have no effect on the temperature in the freezer compartment 24. Additionally, both the freezer compartment temperature and the fresh food compartment temperature can be varied over their entire respective ranges, regardless of the setting of the other control member. By the present invention, such a characteristic can be achieved. However, to achieve such a characteristic would require a modification of the operating limits or capabilities of the refrigeration system (including duct configuration) in the prior art refrigerator 20. That such modification would be required is evident from the different general shapes of envelopes of the characteristic curves of FIGS. 2 and 3. For example, in FIG. 2, a freezer temperature of 5° F would be impossible to achieve at the same time the fresh food temperature is set at 32°. However, if the fresh food temperature were set at 40°, a freezer temperature of 5° would be within the capabilities of the refrigeration system.

Figure 4:
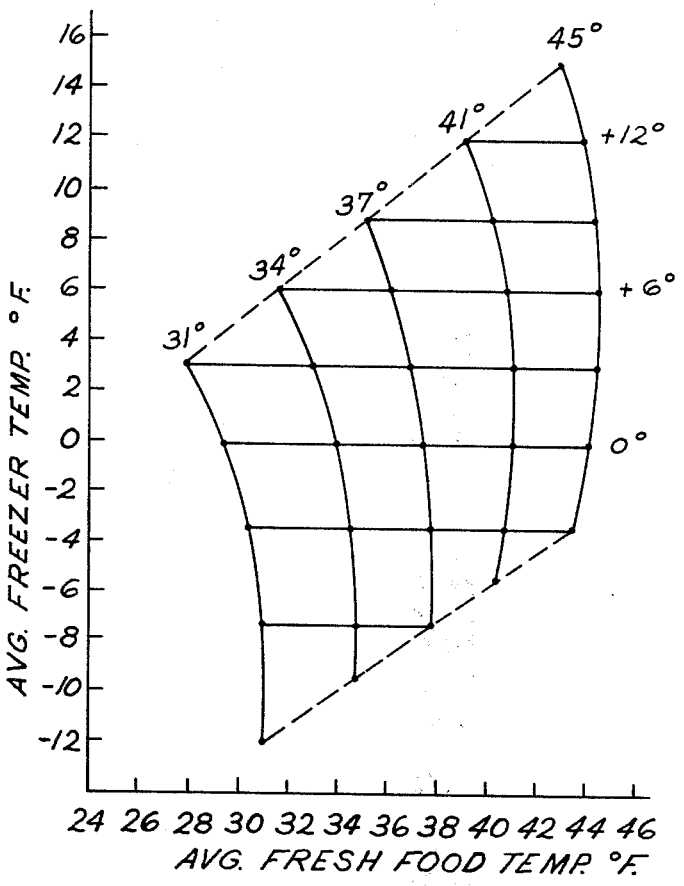
FIG. 4 is a graphical illustration of a temperature control characteristic curve which is within the operating limits of the refrigeration system of the prior art refrigerator shown in FIG. 1.

Referring now to FIG. 4, there is illustrated a temperature control characteristic curve which is achieved by a preferred embodiment of the present invention and which is within the operating limits or capabilities of the refrigeration system of a particular prior art refrigerator. In FIG. 4, the general shape of the curve envelope shown in FIG. 2 is maintained, but the control characteristics are quite different. In FIG. 4, the lines which begin at the freezer temperature settings 12°, 6°, and 0° extend from these numbers substantially horizontally to the left, indicating control independence. This is in contrast to FIG. 2 in which the lines beginning at each of the letters A through E slope downwardly and to the left, indicating control interaction.

Apparatus according to the present invention can be substituted directly in place of the simple damper 58 controlled by the fresh food control 60 of the prior art refrigerator 20 (FIG. 1), resulting in substantially independent control over the freezer and fresh food temperatures but remaining within the operating limits or capabilities of the refrigeration system. Additionally, preferred embodiments of the present invention indicate to the user when the user attempts to set a combination of desired freezer and fresh food compartment temperatures which is not within the operating limits or capabilities of the refrigerator. An example of such a combination, as discussed above, is a freezer temperature of 5° F and a fresh food temperature of 40° F.

Figure 5:
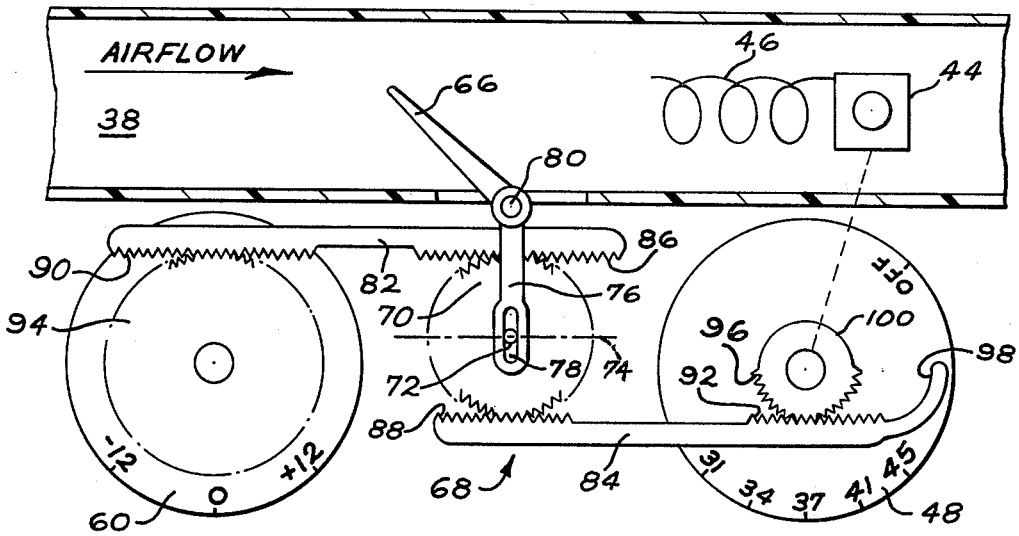
FIG. 5 is a schematic representation of the duct portion of a refrigerator including one embodiment of the invention.

Referring now to FIG. 5, there is shown the duct portion 38 of a refrigerator and a functional schematic representation of the present invention. FIG. 5 is intended to illustrate operational principles of the present invention, and is not necessarily an embodiment which would be constructed. It will be understood that the duct 38 shown in FIG. 5 is similar to the duct 38 in the prior art refrigerator 20 (FIG. 1) and conducts refrigerated evaporator chamber air to the fresh food compartment 26. Other elements in the refrigerator are the same as in the prior art refrigerator 20 and, for convenience of illustration, are not shown. It will be understood that the representation of FIG. 5 is in schematic form only and various supporting and guiding members must be employed to hold the various elements in their proper relative positions.

In FIG. 5, variable airflow control apparatus generally comprises an adjustable air valve, such as a damper 66, operatively connected to the output of a mechanical summer or differential, generally designated at 68. As will be more apparent from the more detailed description which follows, the arrangement is such that the degree of damper opening and therefore airflow through the duct 38 is a direct function of the temperature setting of the freezer control 60 and an inverse function of the temperature setting of the fresh food control 48.

The mechanical summer 68 comprises a driven pinion gear 70 which includes an axle 72. The axis of the pinion gear 70 and of the axle 72 is movable along a line shown as a broken line 74. In the preferred embodiment of the invention, the line 74 is a straight line and the movement of the axis is a translational movement.

The damper 66 is operatively attached to be driven by a slotted yoke member 76, the slot 78 of the yoke being placed over the axle 72 for movement thereby. Movement of the axle 72 along the line 74 causes the slotted yoke member 76 and the damper 66 to rotate about a pivot point 80, varying the degree of opening of the damper 66.

The mechanical summer 68 further includes first and second racks 82 and 84 having toothed faces 86 and 88 which engage the pinion gear 70 on diametrically opposite sides. The racks 82 and 84 also have toothed faces 90 and 92 which engage first and second driving gears 94 and 96. To provide main and compensating inputs to the mechanical summer 68, the driving gears 94 and 96 and connected respectively to the freezer control 60 and the fresh food control 48 for rotation thereby. The connection of the gear 96 to the fresh food control 48 is a ganged connection for operation along with the thermostatic control 44.

In the operation of the embodiment illustrated in FIG. 5, manual rotation of either the freezer control 60 or the fresh food control 48 causes the corresponding rack 82 or 84 to be longitudinally displaced. Displacement of the rack 82 or 84 causes translation of the axis of the pinion gear 70 and the axle 72. Resultant movement of the slotted yoke member 76 causes movement of the damper 66 to effect the desired change in airflow. For normal freezer temperature control, for example, as the freezer control 60 is rotated clockwise to call for a higher freezer temperature, the rack 82 displaces to the right and the axis of pinion gear 70 and the axle 72 translates to the right. This causes the yoke 76 and the damper 66 to rotate counterclockwise about the pivot point 80, opening the damper 66 more to permit increased airflow through the duct 38. As previously explained, increased flow of refrigerated evaporator chamber air through the duct 38 into the fresh food compartment 26 indirectly causes the desired increase in freezer temperature by decreasing the percentage of compressor and evaporator run time.

Still considering the operation of the embodiment of FIG. 5, as the fresh food control 48 is manually rotated clockwise, for example, to call for a higher fresh food temperature, the compressor and evaporator 30, under control of the thermoplastic control 44, operate less frequently. Desirably, temperature in the fresh food compartment 26 increases. If no compensation were provided, then, undesirably, temperature in the freezer compartment 24 would also be increased. However, due to the compensating input from the fresh food control 48 to the second driving gear 96, the rack 84 is displaced to the left and the axis of the pinion gear and axle 70 and 72 translates to the left. The yoke member 76 and the damper 66 rotate clockwise about the pivot point 80, further restricting duct airflow. The further closing of the damper 66 in response to clockwise rotation of the fresh food control 48 produces the same result as a manual adjustment of the freezer control 60 to call for a lower temperature would. Conversely, as the fresh food control 48 is manually rotated counterclockwise to call for a lower fresh food temperature, the evaporator 30 operates more frequently and the fresh food temperature desirably decreases. Counterclockwise rotation of the second driving gear 96 causes displacement of the rack 84 to the right and opening of the damper 66.

The compensation thus provided causes the freezer compartment temperature to remain substantially constant despite changes in the setting of the fresh food control 48. It will be apparent that the design for a specific refrigerator requires a selection of the proper gear diameters and ratios to achieve proper compensation, but such selection is with the skill of one skilled in the art. In the illustrated embodiment, the first driving gear 94 has a larger diameter than the second driving gear 96.

Still referring to FIG. 5, in order to prevent a user from setting the controls to a mutually exclusive pair of temperatures, movement of the pinion gear axis is limited. This limitation may be accomplished by selecting the length of the slot 78 or by including limiting means in the guiding member (not shown). When a user attempts to adjust one of the control members to a setting which, in view of the setting of the other control member, would result in a combination of temperatures outside the operating limits of the refrigerator, the axis of the pinion gear 70 does not translate any further because further movement is prevented. Instead, the pinion gear 70 merely rotates about its axis causing longitudinal displacement of the other rack and resulting rotation of the other control member.

As a concrete example, assume that the freezer control 60 is set at 12° and the fresh food control 48 is set at 41°. Under this condition, the damper 66 is substantially completely open and the pinion gear axis is translated as far to the right as it will go. If the user now operates the fresh food control 48 to call for a lower temperature to be maintained in the fresh food compartment 26, and does not change the setting of the freezer control 60, the user is attempting to call for a combination of temperatures which is not within the operating limits of the refrigerator. A reference to FIG. 4 will confirm this. When the user rotates the fresh food control 48 counterclockwise, the second rack 84 translates farther to the right. Since the pinion gear axis cannot translate farther to the right, the pinion gear 70 rotates counterclockwise about its axis, causing the first rack 82 to move to the left. This causes the freezer control 60 to rotate counterclockwise to a lower temperature setting, indicating to the user that the combination of temperature settings he was trying to get is not within the capabilities of the refrigerator.

In order to permit the fresh food control 48 and thus the thermostatic control 44 to be rotated extremely clockwise to an OFF position, the second driving gear 96 and the second rack 84 include lost motion gearing. The lost motion gearing comprises a curved extension 98 of the rack 84, which curved extension does not include gear teeth. A corresponding portion 100 of the second driving gear 96 is also devoid of gear teeth. When the fresh food control 48 is rotated sufficiently clockwise, the portion 100 and the curved extension 98 are in contact, permitting further clockwise rotation of the control 48 without movement of the second rack 84.

Figure 6:
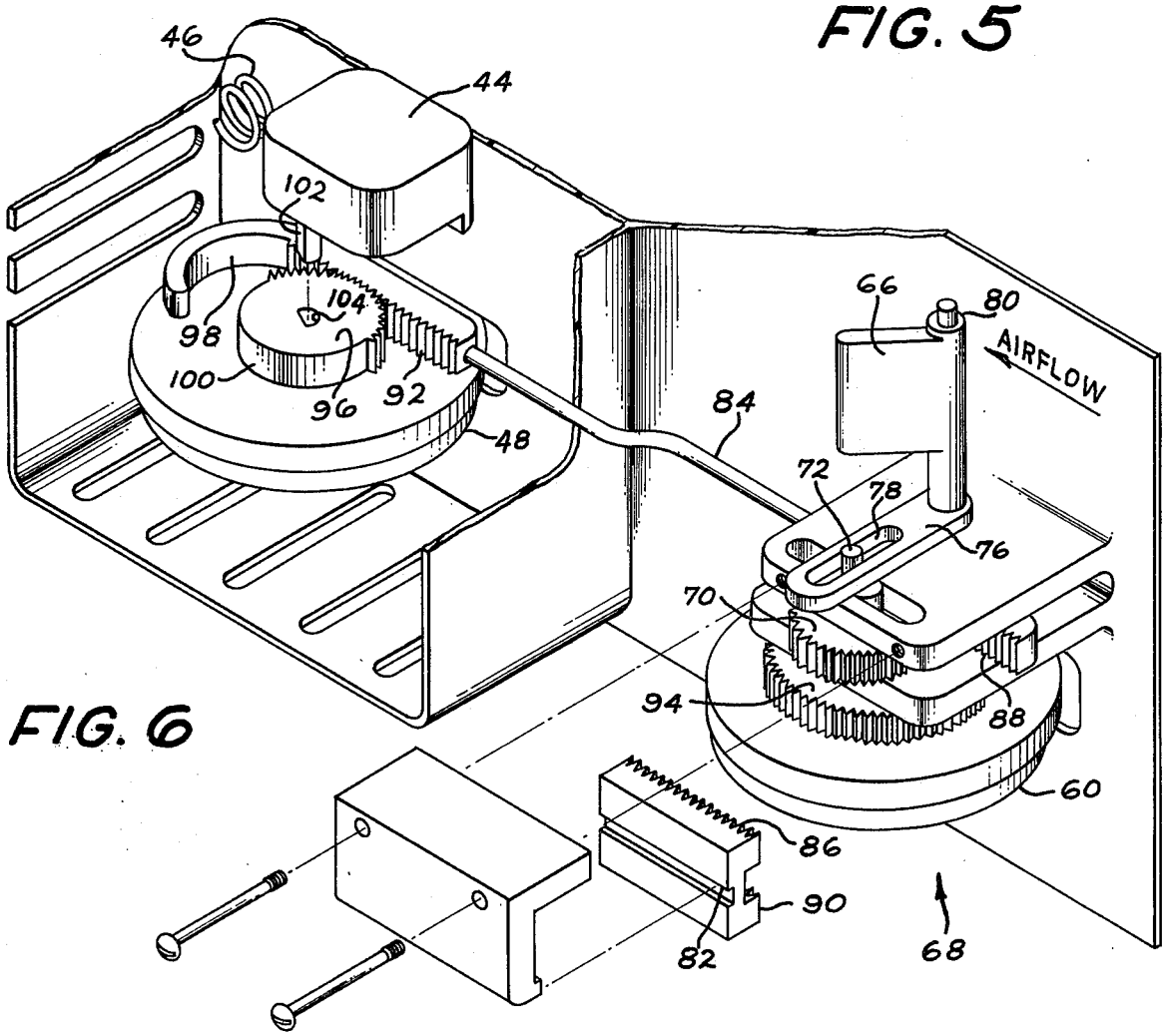
FIG. 6 is a perspective view of a portion of another embodiment of the present invention.

Referring now to FIG. 6, there is shown a rear perspective view of a preferred embodiment of the present invention. The elements and operation of FIG. 6 are substantially identical to those of FIG. 5, and the corresponding elements are designated by identical reference numerals. FIG. 6 differs from FIG. 5 in that the arrangement of the parts is altered, but the operation is substantially the same. A description of the operation is therefore not repeated. In FIG. 6, airflow is from right to left across the rear of the apparatus. For clarity of illustration, the direct connection between the fresh flood control 48 and the thermostatic control 44 is exploded. The shaft 102 of the thermostatic control 96 engages a corresponding opening 104 in the second driving gear 96. The first rack 82 (exploded illustration) which engages the first driving gear 94 and the pinion 70 is short and has the gear faces 86 and 90 located above one another. The second rack 82 which engages the second driving gear 96 and the pinion gear 70 is elongated, having the gear 88 and 92 at opposite ends.

Figure 7:
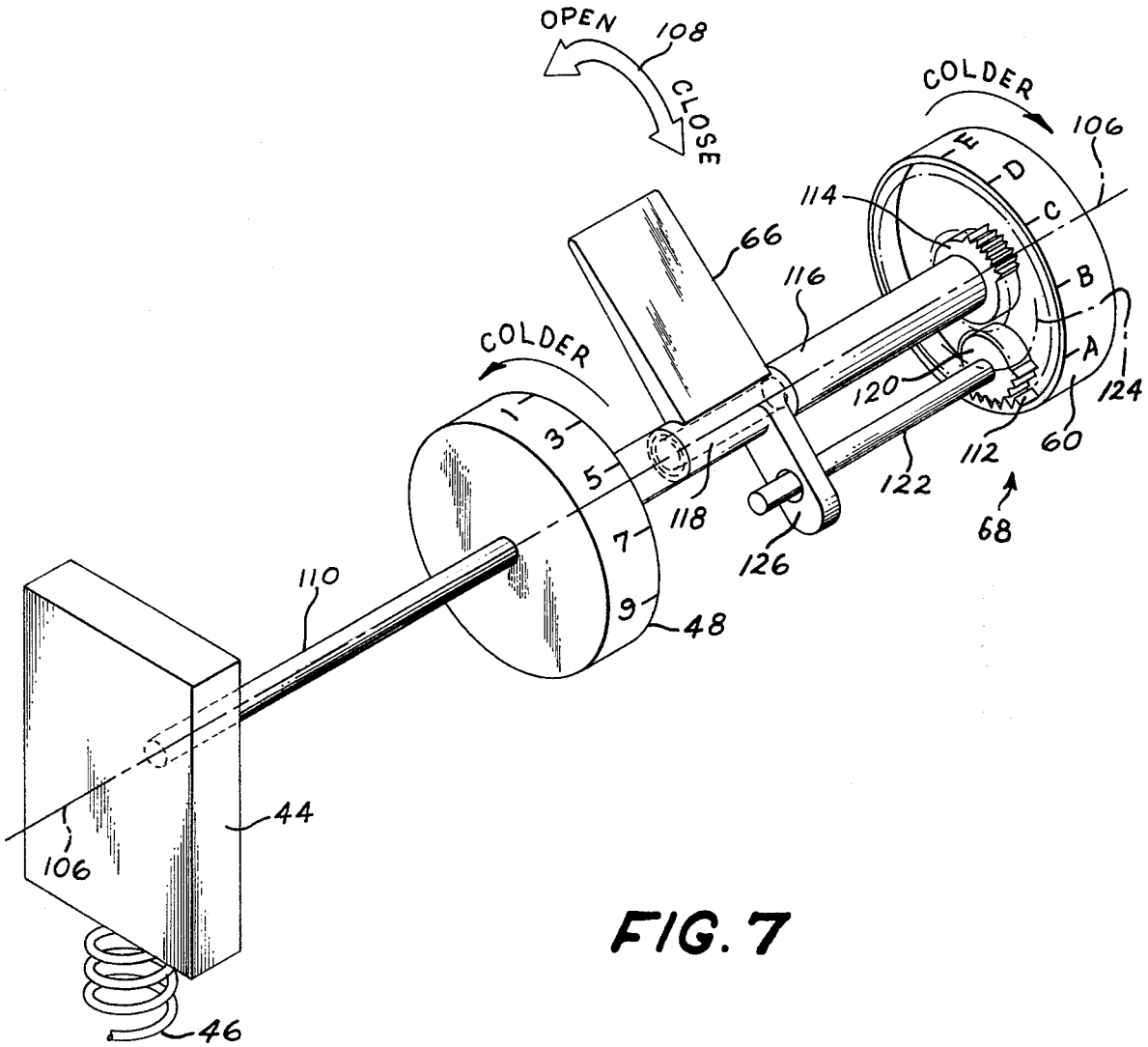
FIG. 7 is a perspective view of a portion of still another embodiment of the present invention.

Referring now to FIG. 7, there is shown an embodiment of the present invention which permits the fresh food and freezer controls 48 and 60 to be rotatable and in axial alignment along a major axis, shown as a broken line 106. In FIG. 7, it will be understood that the damper 66 is disposed within a duct (not shown) which is analogous to the duct 38 (FIG. 1). As indicated by the arrow 108, the damper 66 is disposed within the duct in a manner such that, as the damper 66 moves rearwardly, it opens more, allowing increased flow of refrigerated evaporator chamber air into the fresh food compartment 26; as the damper 66 moves forwardly, it closes more, decreasing airflow into the fresh food compartment 26. Conventionally, the fresh food control 48 is connected by a rotatable shaft 110 to the thermostatic control 44 which maintains the desired temperature in the fresh food compartment 26 by energizing the evaporator 30 as required.

The mechanical summer 68 (FIG. 7) generally comprises a planetary gear arrangement. A driving ring gear 112 is firmly attached to the freezer control 60 for rotation thereby about the major axis 106. A driving central gear 114 is located within the ring gear 112 and is connected through a shaft 116 extending along the major axis 106 for rotation by the fresh food control 48. A portion 118 of the shaft 116 is of reduced diameter for holding and for providing a pivot for the damper 66. A driven pinion gear 120 engages both the ring gear 112 and the central gear 114 and is attached to a rotatable shaft or axle 122. The axis common to the pinion gear 120 and the shaft or axle 122 is movable in an arcuate path 124 about the major axis 106. In order to provide an output for the summer 68, a pinion gear carrier 126 engages the shaft or axle 122 for rotation about the pivot 118 in response to movement of the pinion gear axis along the arcuate path 124. The pinion gear carrier 126 is connected to operate the damper 66.

It will be apparent that the position of the pinion gear axis along the arcuate path 124 is a function of the settings of both of the control members 48 and 60. The carrier 126 serves to cause a corresponding degree of opening of the damper 66. As a result, the flow of refrigerated evaporator chamber air into the fresh food compartment 26 is the proper function of the settings of both control members 48 and 60.

The operative of the embodiment illustrated in FIG. 7 will now be explained. For normal freezer temperature control, as the freezer control 60 is rotated clockwise (in the direction of the arrow) to call for a colder freezer temperature, rotation of the ring gear 112 causes the axis of the pinion gear 120 to move clockwise along the arcuate path 124. The pinion gear carrier 126 causes the damper 66 to pivot towards the closed position, decreasing airflow through the duct. As previously explained, decreased flow of refrigerated evaporator chamber air through the duct into the fresh food compartment indirectly causes the desired decrease in freezer temperature by increasing the percentage of compressor and evaporator run time. Conversely, as the freezer control 60 is rotated counterclockwise to call for a warmer freezer temperature, the damper 66 pivots towards the open position.

Considering now the operation of the compensating feature of the embodiment of FIG. 7, as the fresh food control 48 is rotated counterclockwise (in the direction of the arrow) to call for a colder fresh food temperature, the compressor and evaporator, under control of the thermostatic control 44, operate more frequently. Desirably, fresh food compartment temperature decreases. If no compensation were provided, then, undesirably, freezer temperature would also increase. However, counterclockwise rotation of the central gear 114 causes the axis of the pinion gear 120 to move counterclockwise along the arcuate path 124. The pinion gear carrier 126 causes the damper 66 to pivot towards the open position, increasing airflow through the duct. Conversely, clockwise rotation of the fresh food control 48 to call for a higher fresh food temperature results in decreased airflow through the duct.

The present invention therefore provides a single evaporator, single fan combination refrigerator which has substantially independent fresh food and freezer temperature controls.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A refrigerator comprising:

a. a freezer compartment;

b. a fresh food compartment;

c. an evaporator chamber and an evaporator in said chamber;

d. an air circulation system including a fan and passageways for circulating air from both of said compartments through said evaporator chamber, a passageway for conducting a first stream of air from said evaporator chamber to said freezer compartment, and a duct for conducting a second stream of air from said evaporator chamber to said fresh food compartment;

e. a thermostatic control for maintaining a desired temperature in said fresh food compartment by causing energization of said evaporator as required, said thermostatic control including an element for sensing temperature in said fresh food compartment;

f. a first user-operable control member for setting a desired temperature to be maintained in said freezer compartment;

g. a second user-operable control member for setting the desired temperature to be maintained in said fresh food compartment, said second user-operable control member being operatively connected to said thermostatic control; and h. variable airflow control apparatus for varying airflow through said duct as a function of the settings of both of said user-operable control members, said apparatus including:

i. an adjustable air valve for controlling airflow through said duct; and ii. a mechanical summer having a main input connected to said first user-operable control member, a compensating input connectd to said second user-operable control member, and an output operatively connected to said air valve, the connection to said air valve being such that the degree of opening of said air valve is a direct function of the temperature setting of said first user-operable control member and an inverse function of the temperature setting of said second user-operable control member, said function being selected so that the desired temperature is approximately maintained in said freezer compartment even though the setting of said second user-operable control member is changed.

2. A refrigerator according to claim 1, wherein said mechanical summer comprises:

a. a driven pinion gear including an axle, said pinion gear and axle having a common axis which is movable along a line;

b. first and second racks engaging said pinion gear on diametrically opposite sides such that the position of said pinion gear axis represents the sum of the longitudinal displacements of said first and second racks;

c. output means for controlling the degree of opening of said air valve in response to the position of said pinion gear axis;

d. first and second driving gears connected to said first and second user-operable control members and engaging said first and second racks to cause longitudinal displacement thereof in response to operation of said control members.

3. A refrigerator according to claim 2, wherein said output means comprises a slotted yoke member having a slot engaging said pinion gear axle.

4. A refrigerator according to claim 2, wherein the movement of the pinion gear axis is limited to prevent said user-operable control members from being set to a combination of freezer and fresh food temperatures which is not within the capabilities of the refrigerator.

5. A refrigerator according to claim 2, wherein said second driving gear and said second rack include lost motion gearing to permit said second user-operable control member and thus said thermostatic control to be moved to an OFF position.

6. A refrigerator according to claim 1, wherein said mechanical summer comprises:

a. a driving ring gear firmly attached to one of said manually-operable control members and rotatable therewith about a major axis;

b. a driving central gear located within said ring gear, coaxially therewith, and having a shaft extending along the major axis and connected to the other one of said user-operable control members;

c. a pinion gear engaging both said ring gear and said central gear, said pinion gear having an axle movable in an accurate path;

d. a pinion gear carrier engaging said axle and serving as the output of said summer.

* * * * *

UNITED STATES PATENT AND TRADEMARK OFFICE

CERTIFICATE OF CORRECTION

PATENT NO. : 4,009,591

DATED : March 1, 1977

INVENTOR(S) : WILLIAM F. HESTER

It is certified that error appears in the above-identified patent and that said Letters Patent are hereby corrected as shown below:

Column 2, line 21, "decreases" should read -- increases --.

Column 5, line 4, "decreases" should read -- increases --.

Column 12, line 32, "increase" should read -- decrease --.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*